US011490750B1

(12) United States Patent
Su et al.

(10) Patent No.: US 11,490,750 B1
(45) Date of Patent: Nov. 8, 2022

(54) VERSATILE TABLEWARE DEVICE

(71) Applicants: Yen-Shuo Su, Hsinchu (TW); Chunming Cheng, Hsinchu (TW)

(72) Inventors: Yen-Shuo Su, Hsinchu (TW); Chunming Cheng, Hsinchu (TW)

(73) Assignee: Befashion Umbrella Co., Ltd., Hsinchu (TW)

( * ) Notice: Subject to any disclaimer, the term of this patent is extended or adjusted under 35 U.S.C. 154(b) by 40 days.

(21) Appl. No.: 17/313,035

(22) Filed: May 6, 2021

(51) Int. Cl.
*A47G 21/06* (2006.01)

(52) U.S. Cl.
CPC ..... *A47G 21/06* (2013.01)

(58) Field of Classification Search
CPC ..... A47G 21/06; A47G 21/02; A47G 21/023; A47G 21/04
USPC ..... 30/122, 142, 137, 147, 148, 149, 150
See application file for complete search history.

(56) References Cited

U.S. PATENT DOCUMENTS 5,735,050 A * 4/1998 Hsieh ..... A47G 21/04 30/322
5,940,974 A * 8/1999 Lee ..... A47G 21/02 30/322
2003/0097759 A1* 5/2003 Bond ..... A47J 43/288 30/340
2008/0229585 A1* 9/2008 Kelly ..... A47J 43/281 30/142
2021/0386228 A1* 12/2021 Mertzel ..... A47G 21/02

* cited by examiner

*Primary Examiner* — Phong H Nguyen
(74) *Attorney, Agent, or Firm* — Bradley J. Thorson; DeWitt LLP

(57) ABSTRACT

A tableware device includes a main body and multiple tableware members. The main body has a lower cover and an upper cover. The upper cover has a first fastener. A receiving space is formed between the upper cover and the lower cover. An end of the lower cover is rotatably connected to an end of the upper cover by a pivoting portion, and free ends thereof jointly form an opening. The lower cover is formed with a first connecting portion and a second fastener corresponding to the first fastener to fasten the upper and lower covers. The tableware members are removably disposed on the main body. Each is provided with a second connecting portion corresponding to the first connecting portion to connect the tableware member with the main body.

12 Claims, 10 Drawing Sheets

A

VERSATILE TABLEWARE DEVICE

BACKGROUND

Technical Field

The invention relates to tableware, particularly to a tableware device which is convenient to be carried and washed and is easy to be replaced with different functions with one hand.

Related Art

With progressiveness and development of the society, many people have to dine out due to busyness. As a result, the number of people who dine out has increased greatly. To satisfy requirements of take-out customers, the food service usually provides disposable tableware. However, disposable tableware must be sterilized, shaped and bleached in the manufacture, so chemicals always remain on the tableware to damage users' health. Also, the disposability after use of disposable tableware brings a great amount of garbage. Accordingly, reusable tableware appears in the market. However, reusable tableware has various types, a use may need to carry about several types of tableware, and so reusable tableware is disadvantageous to carrying. Also, reusable tableware is hard to be washed immediately after use to cause inconvenience. Thus, reusable tableware has been hard to be popular.

SUMMARY

An object of the invention is to provide a versatile tableware device, which can be easy to be carried and correspond to various types of food.

To accomplish the above object, the invention provides a versatile tableware device, which includes a main body and multiple tableware members. The main body has a lower cover and an upper cover covering the lower cover. The upper cover has a first fastener. A receiving space is formed between the upper cover and the lower cover. An end of the lower cover is rotatably connected to an end of the upper cover by a pivoting portion to make the upper cover and the lower cover opened or closed on the pivoting portion. Free ends of the upper and lower covers jointly form an opening. An inside of the lower cover is formed with a first connecting portion and a second fastener. The second fastener is arranged corresponding to the first fastener to make the upper and lower covers fasten each other. The multiple tableware members are optionally removably disposed on the main body. Each tableware member is provided with a second connecting portion arranged corresponding to the first connecting portion to connect the tableware member with the main body. The tableware members are swayable by a pivot formed by the first and second connecting portions. A storage status is formed when the tableware members are swayed into the receiving space, and a use status is formed when the tableware members are swayed out of the opening. One of the tableware members is capable of being removed from the main body to be replaced with another one.

In the versatile tableware device of the invention, the main body is a holding portion for being held by a hand, and the receiving space is disposed in the holding portion.

In the versatile tableware device of the invention, the tableware members are a spoon, a fork, a fruit fork or a knife.

In the versatile tableware device of the invention, the tableware member being swayed into the receiving space has a first position, and the tableware member being swayed out of the receiving space has a second position.

In the versatile tableware device of the invention, the second position is the tableware member being swayed 180 degrees from the first position.

The versatile tableware device of the invention further comprises a hook portion which is rotatably connected to the pivoting portion and outward extends out of the main body.

In the versatile tableware device of the invention, the pivoting portion is comprised of two spindle holes at an end of the upper cover and a spindle at an end of the lower cover.

In the versatile tableware device of the invention, the first connecting portion is a shaft, the second connecting portion is a sleeve, a lateral edge of the shaft is formed with a notch, an inner edge of the sleeve is formed with a protrusion matching the notch, a bottom of the shaft has an adapting portion, the adapting portion is arranged corresponding to the protrusion, and the protrusion is slid into the notch to enter the adapting portion to be slidable on the shaft.

In the versatile tableware device of the invention, the adapting portion is an annular trough.

In the versatile tableware device of the invention, the tableware member further has a third position at which the tableware member is capable of being removed, and the third position is the tableware being swayed 90 degrees from the first position or the second position.

In the versatile tableware device of the invention, each of two sides of the lower cover is provided with an extending portion, each extending portion is outward extended with the second fastener, each of two sides of the upper cover is provided with a recess portion, an inner side of each recess portion is formed with the first fastener, and the second fastener engages with the second fastener when the upper cover and the lower cover are closed.

In the versatile tableware device of the invention, the second fastener is a block, the first fastener is a hole matching the block, and the extending portion and the recess portion are shaped into corresponding contours.

The versatile tableware device of the invention can rapidly change the tableware members by means of the first and second connecting portions to deal with various food. Removed tableware members can be immediately washed. Also, the tableware member can be received in the receiving space. Thus, carrying and storage are very easy. In addition, the fasteners of the invention can be pressed by one hand to make the tableware member fall down, and only turning the main body over can close the upper cover to use or receive the tableware member. Thus, operating with one hand is so easy. This can increase willingness to use and improve the drawbacks and problems of conventional tableware.

DETAILED DESCRIPTION

Figure 1:
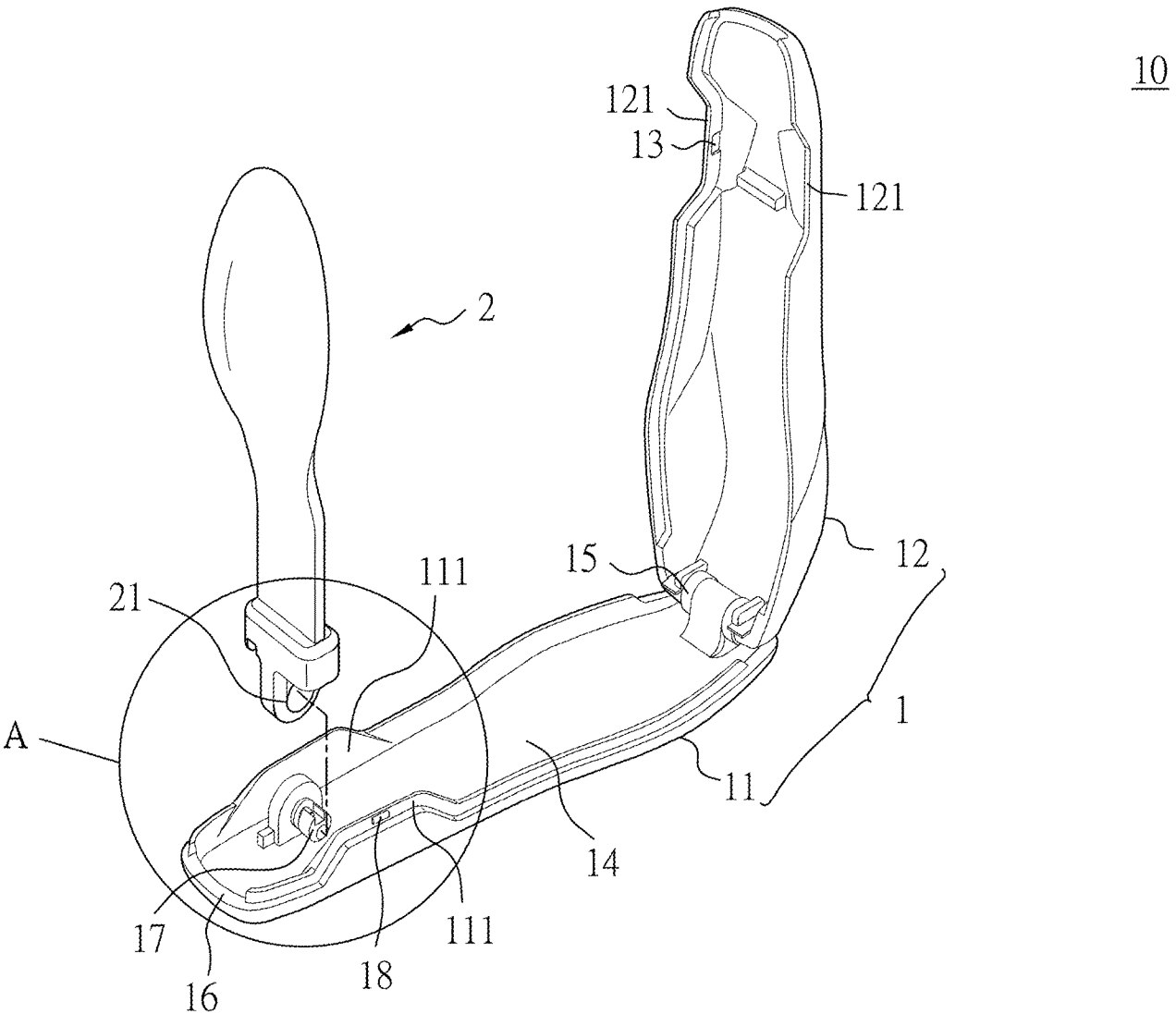
FIG. 1 is an exploded view of the versatile tableware device of the invention.
Figure 1A:
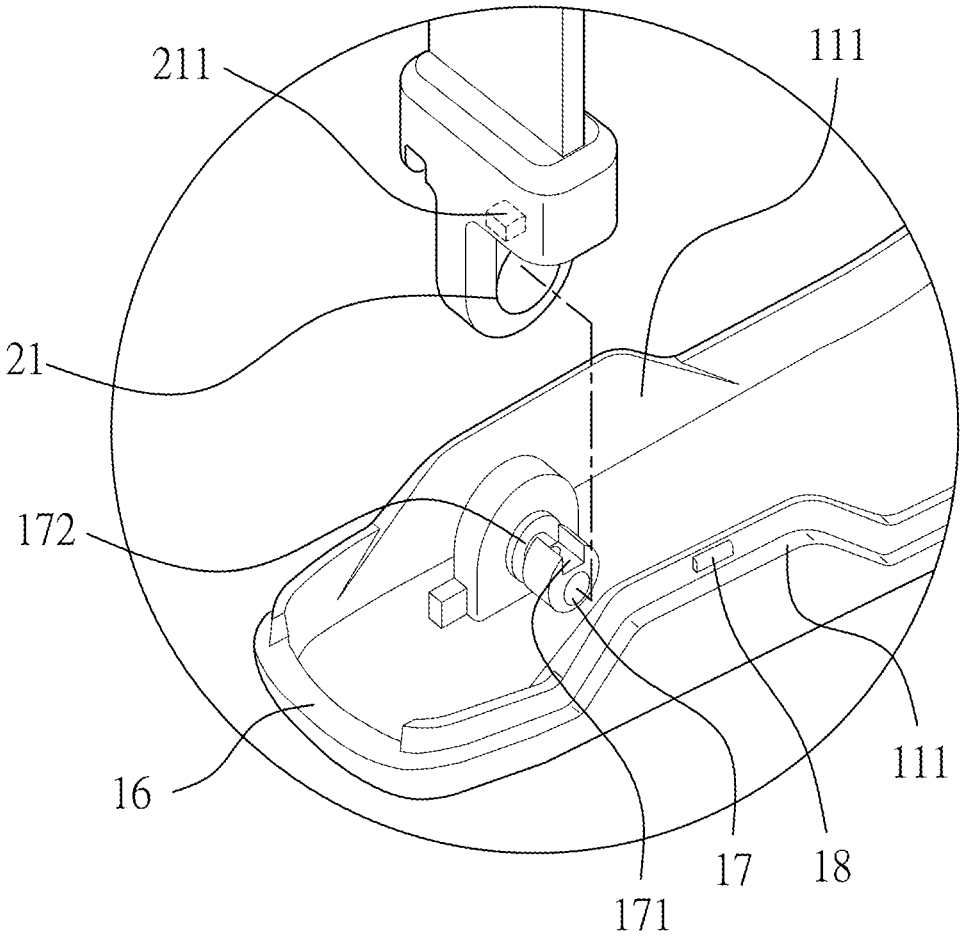
FIG. 1A is a partially enlarged view of FIG. 1.
Figure 2:
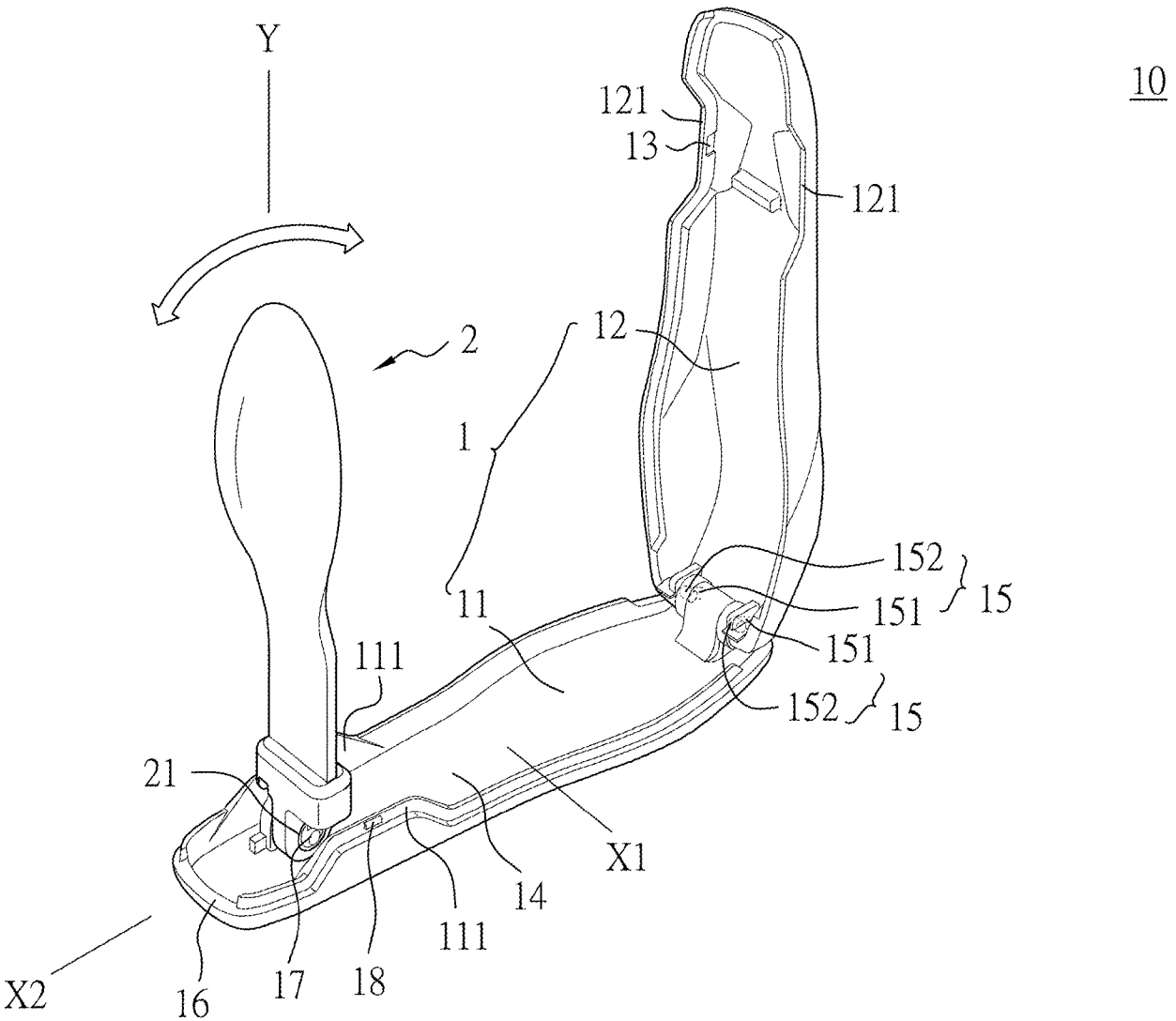
FIG. 2 is an assembled view of the versatile tableware device of the invention.

The technical contents of this disclosure will become apparent with the detailed description of embodiments accompanied with the illustration of related drawings as follows. It is intended that the embodiments and drawings disclosed herein are to be considered illustrative rather than restrictive.

Please refer to FIGS. 1-4. The invention provides a versatile tableware device. The versatile tableware device 10 includes a main body 1 and multiple tableware members 2. In this embodiment, the main body 1 is a holding portion for being held by a hand. The main body 1 has a lower cover 11 and an upper cover 12 covering the lower cover 11. An inner side of the upper cover 12 has a first fastener 13. A receiving space 14 is formed between the upper cover 12 and the lower cover 11. In this embodiment, the receiving space 14 is disposed in the holding portion. An end of the lower cover 11 is rotatably connected to an end of the upper cover 12 by a pivoting portion 15 to make the upper cover 12 and the lower cover 11 opened or closed on the pivoting portion 15. Free ends of the upper and lower covers 12, 11 jointly form an opening 16. The inside of the lower cover 11 is formed with a first connecting portion 17 and a second fastener 18. The second fastener 18 is arranged corresponding to the first fastener 13 to make the upper and lower covers 12, 11 fasten each other.

Figure 3:
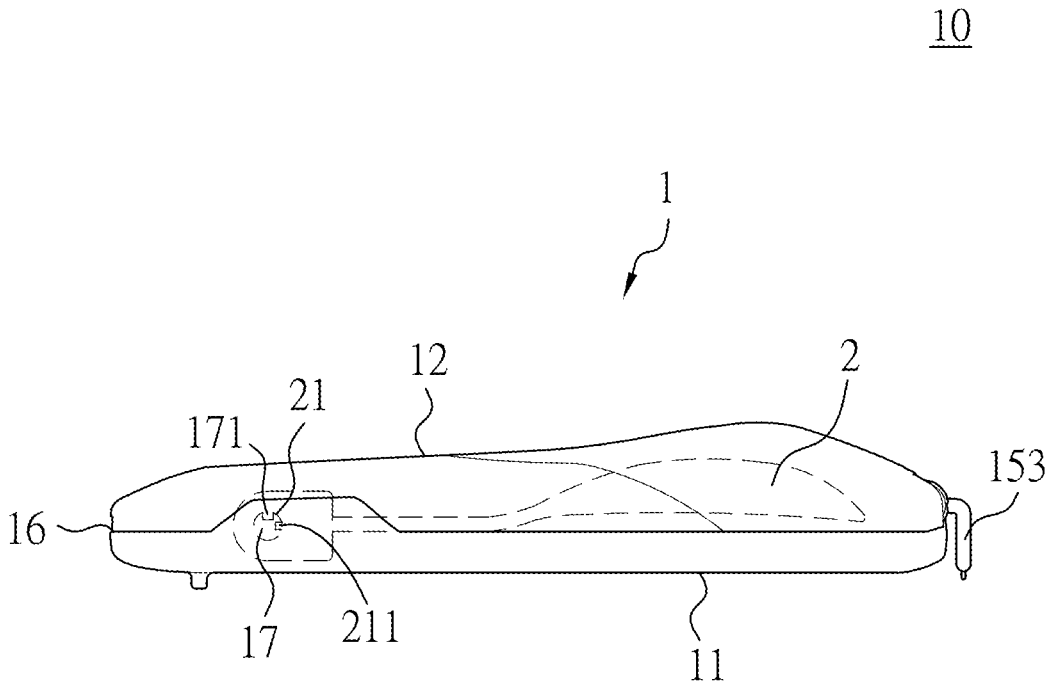
FIG. 3 is a side schematic view of the versatile tableware device of the invention in the storage status.
Figure 4:
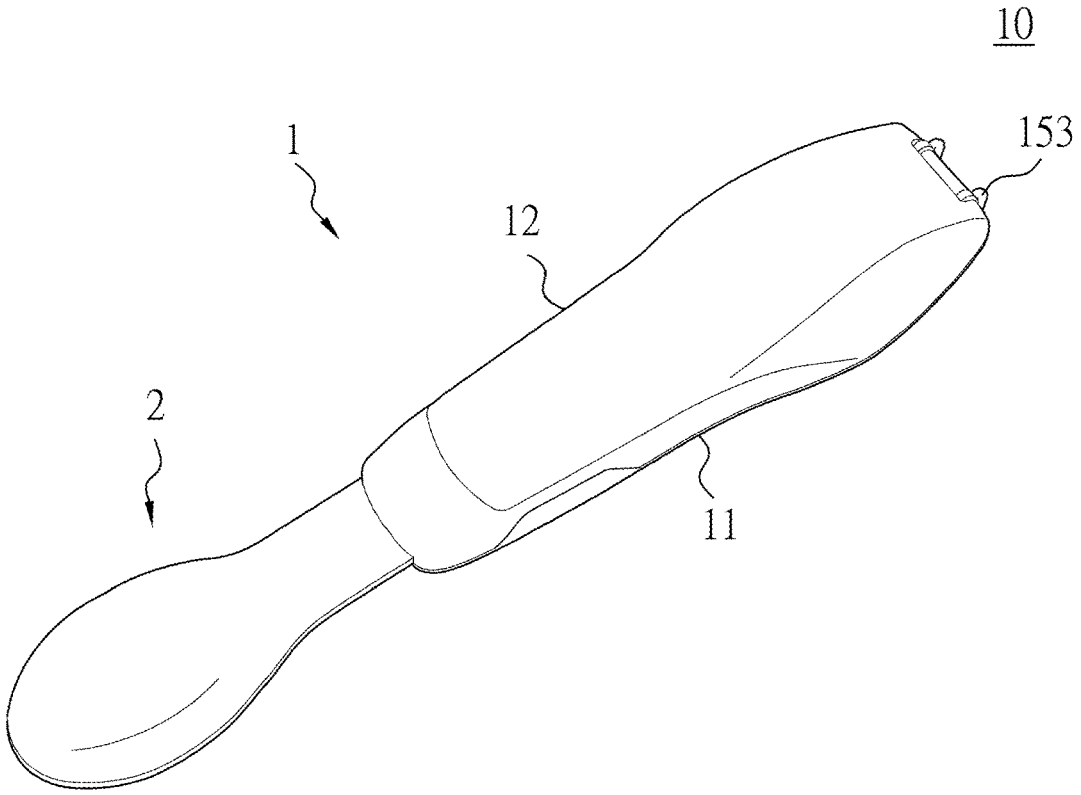
FIG. 4 is a perspective schematic view of the versatile tableware device of the invention in the use status.
Figure 5:
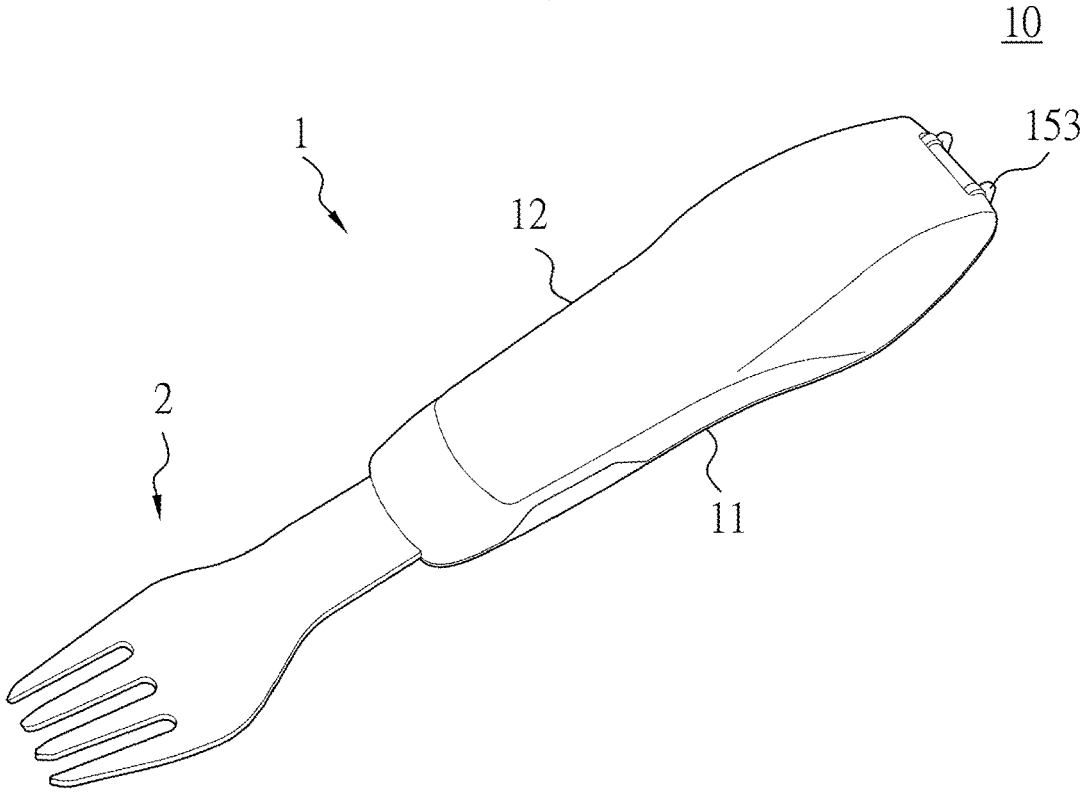
FIG. 5 is another perspective schematic view of the versatile tableware device of the invention in the use status.

The multiple tableware members 2 are optionally removably disposed on the main body 1. In the embodiment shown in FIG. 5, the tableware member 2 are a spoon and a fork as an example, but not limited to these, a fruit fork or a knife is also available. Each tableware member 2 is provided with a second connecting portion 21 arranged corresponding to the first connecting portion 17 to connect the tableware member 2 with the main body 1 to a form a complete tableware device. The tableware member is swayable by a pivot formed by the first and second connecting portions 17, 21. A storage status is formed when the tableware members 2 are swayed into the receiving space 14 as shown in FIG. 3, and a use status is formed when the tableware members 2 are swayed out of the opening 16 as shown in FIG. 4. One of the tableware members 2 is capable of being removed from the main body 1 to be replaced with another one.

In the embodiment, the first connecting portion 17 is a shaft and the second connecting portion 21 is a sleeve, but not limited to these, other structures may also be available depending on actual requirements. A lateral edge of the shaft 17 is formed with a notch 171. An inner edge of the sleeve 21 is formed with a protrusion 211 matching the notch 171. The bottom of the shaft 17 has an adapting portion 172. In the embodiment, the adapting portion 172 is an annular trough 172 arranged corresponding to the protrusion 211. The protrusion 211 is slid into the notch 171 to enter the adapting portion 172 to be slidable on the shaft 17.

In addition, in the embodiment, each of two sides of the lower cover 11 is provided with an extending portion 111. Each extending portion 111 is outward extended with the second fastener 18. In the embodiment, the second fastener 18 is a block. Each of two sides of the upper cover 12 is provided with a recess portion 121. The inner side of each recess portion 121 is formed with the first fastener 13. In the embodiment, the first fastener 13 is a hole matching the block and the extending portion 111 and the recess portion 121 are shaped into corresponding contours, so that the second fastener 18 engages with the first fastener 13 when the upper cover 12 and the lower cover 11 are closed.

The pivoting portion 15 is composed of two spindle holes 151 at an end of the upper cover 12 and a spindle 152 at an end of the lower cover 11. Preferably, the invention further includes a hook portion 153 which is rotatably connected to the pivoting portion 15 and outward extends out of the main body 1 to hang the main body 1 for easy carrying. In addition, the tableware member 2 being swayed into the receiving space 14 has a first position X1, and the tableware member 2 being swayed out of the receiving space 14 has a second position X2. The second position X2 is the tableware member 2 being swayed 180 degrees from the first position X1. The tableware member 2 further has a third position Y at which the tableware member 2 can be removed. The third position Y is the tableware member 2 being swayed 90 degrees from the first position X1 or the second position X2.

Please refer to FIGS. 1-4. The rapid assembling manner of the versatile tableware device of the invention will be described below. When assembling the versatile tableware device of the invention, open the upper cover 12 first, place the sleeve 21 of one of the tableware members 2 around the shaft 17, and then slide the protrusion 211 into the notch 171 and enter the annular trough 172 to be slidable to finish the assembling. When removing or change another one of the tableware members 2, sway the tableware member 2 to the third position Y. At this time, the protrusion 211 is moved to a position corresponding to the notch 171. Then pull out the tableware member 2. At this time, the protrusion 211 separates from the notch 171, so that the tableware member 2 is removed from the main body 1. After that, another tableware member 2 can be installed by repeating the above assembling steps.

Figure 6:
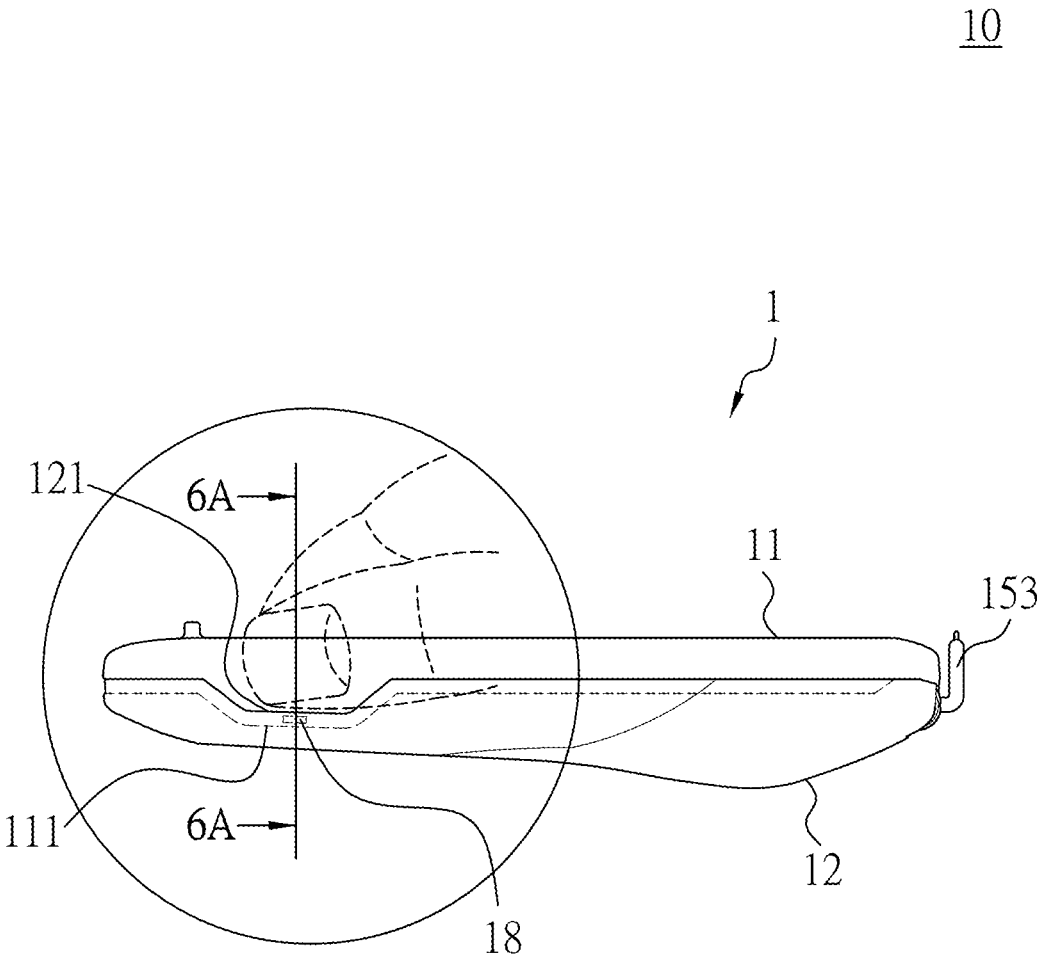
FIG. 6 is a side perspective schematic view of the versatile tableware device of the invention which is being used by a single hand.
Figure 6A:
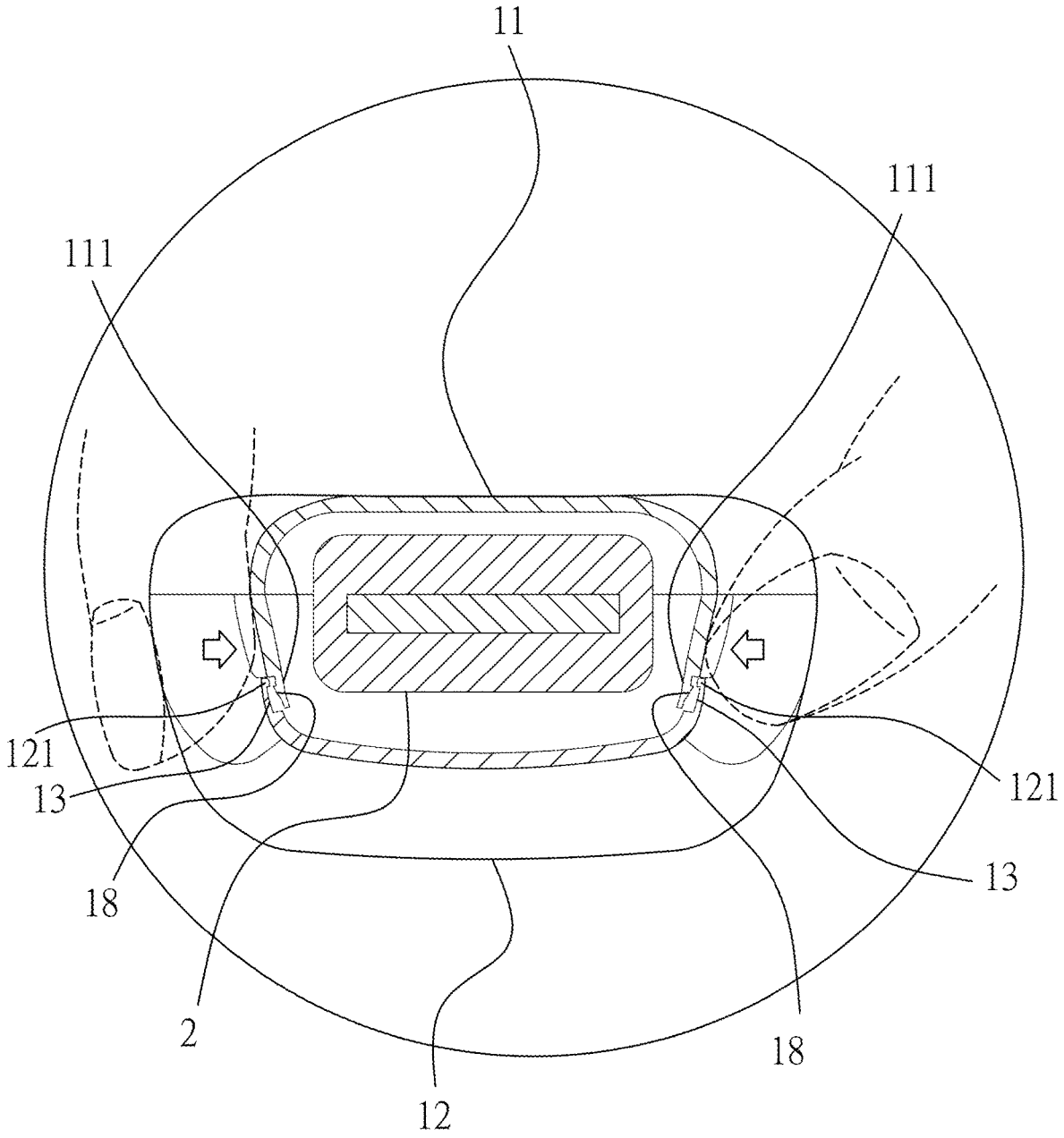
FIG. 6A is a cross-sectional view along line 6A-6A in FIG. 6.
Figure 7:
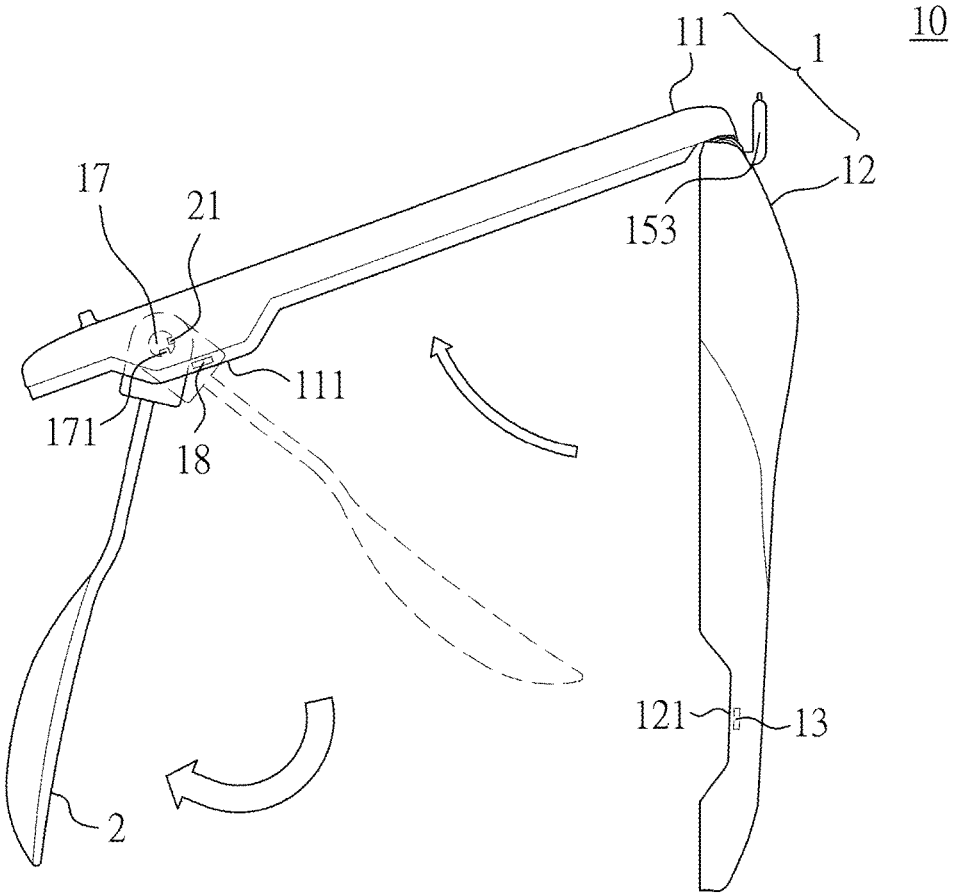
FIGS. 7 and 8 are another two side perspective schematic views of the versatile tableware device of the invention which is being used by a single hand.
Figure 8:
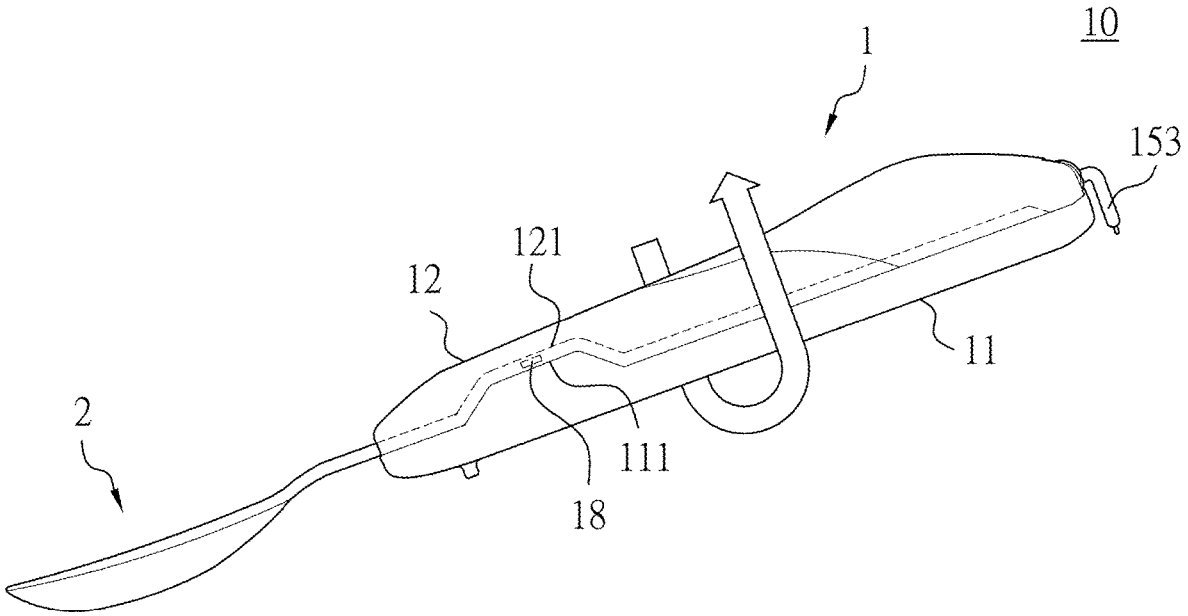
Figure 9:
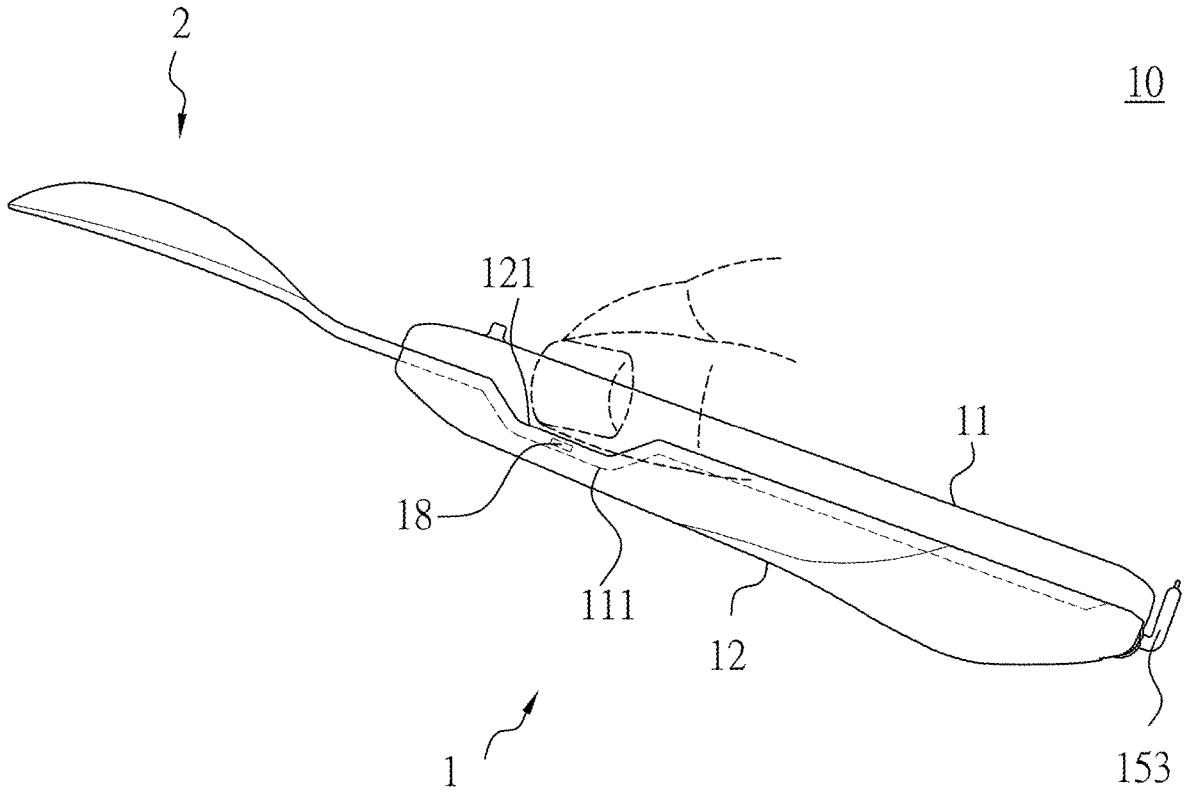
FIGS. 9-11 are three side perspective schematic views of the versatile tableware device of the invention which is being folded by a single hand for storage.
Figure 10:
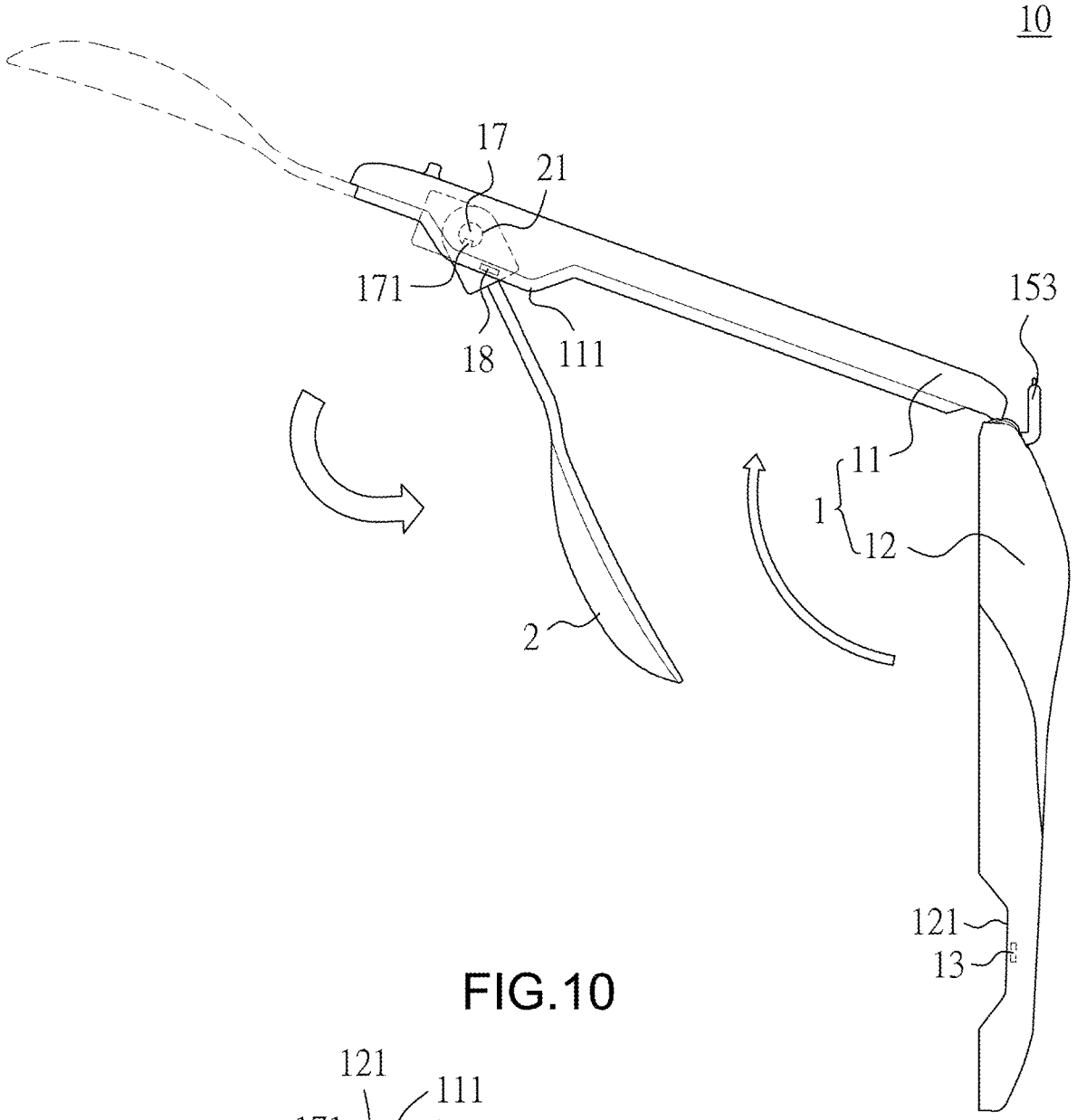
Figure 11:
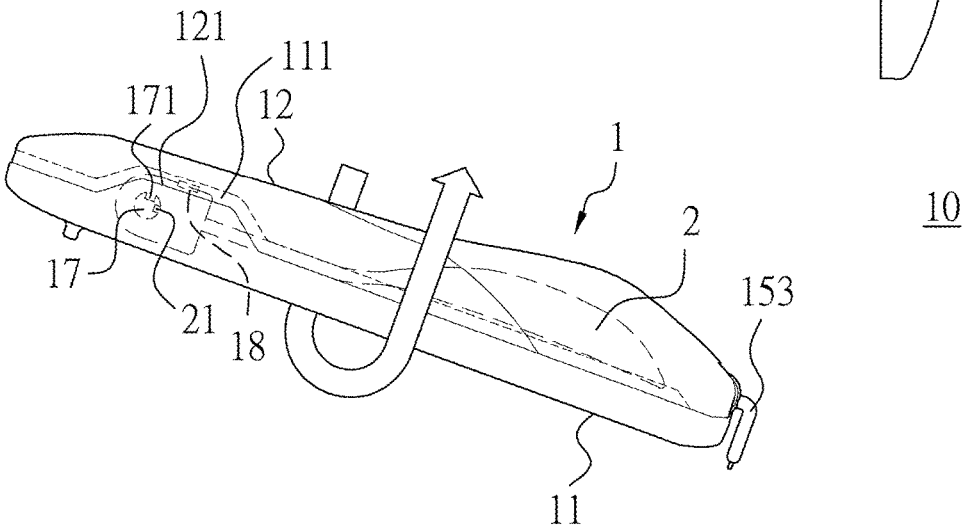

Please refer to FIGS. 6-11. The manner of using and folding the versatile tableware device of the invention with one hand will be described below. First, turn the main body 1 over to make the lower cover 11 face up. Then, use the thumb and the index finger to inward press two sides of the lower cover 11, i.e., a lower position of the extending portion 111, to separate and disengage the second fastener 18 and the first fastener 13 as shown in FIGS. 6 and 6A. At this time, the upper cover 12 and the tableware member 2 will fall down as shown in FIG. 7. When the tableware member 2 is swayed forward, use one hand to turn back the main body 1 to make the tableware member 2 located at the second position X2 and make the upper cover 12 face up and press the upper cover 12 to engage the first fastener 13 with the second fastener 18. After that, the tableware member 2 can be used as shown in FIG. 8. When a user wants to fold the tableware member 2 after use, only one hand is required. First, turn the main body 1 over to make the bottom face up. Then, use the thumb and the index finger to inward press two sides of the lower cover 11, i.e., a lower position of the extending portion 111, to separate and disengage the second fastener 18 and the first fastener 13 as shown in FIG. 9. At this time, the upper cover 12 and the tableware member 2 will fall down as shown in FIG. 10. When the tableware member 2 is swayed rearward, use one hand to turn back the main body 1 to make the tableware member 2 located at the first position X1 and make the upper cover 12 face up and press the upper cover 12 to engage the first fastener 13 with the second fastener 18. After that, the tableware member 2 can be folded as shown in FIG. 11.

In sum, the versatile tableware device of the invention can rapidly change the tableware members by means of the first and second connecting portions to deal with various food. Removed tableware members can be immediately washed. Also, the tableware member can be received in the receiving space. Thus, carrying and storage are very easy. In addition, the fasteners of the invention can be pressed by one hand to make the tableware member fall down, and only turning the main body over can close the upper cover to use or receive the tableware member. Thus, operating with one hand is so easy. This can increase willingness to use and improve the drawbacks and problems of conventional tableware.

While the invention has been described by means of specific embodiments, numerous modifications and variations could be made thereto by those skilled in the art without departing from the scope and spirit of this disclosure set forth in the claims.

What is claimed is:

1. A versatile tableware device comprising:

a main body, having a lower cover and an upper cover covering the lower cover, the upper cover having a first fastener, a receiving space being formed between the upper cover and the lower cover, an end of the lower cover being rotatably connected to an end of the upper cover by a pivoting portion to make the upper cover and the lower cover opened or closed on the pivoting portion, free ends of the upper and lower covers jointly forming an opening, an inside of the lower cover being formed with a first connecting portion and a second fastener, the second fastener being arranged corresponding to the first fastener to make the upper and lower covers fasten each other; and multiple tableware members, optionally removably disposed on the main body, each being provided with a second connecting portion arranged corresponding to the first connecting portion to connect the tableware member with the main body, the tableware members being swayable by a pivot formed by the first and second connecting portions;

wherein a storage status is formed when the tableware members are swayed into the receiving space, a use status is formed when the tableware members are swayed out of the opening, and one of the tableware members is capable of being removed from the main body to be replaced with another one.

2. The versatile tableware device of claim 1, wherein the main body is a holding portion for being held by a hand, and the receiving space is disposed in the holding portion.

3. The versatile tableware device of claim 1, wherein the tableware members are a spoon, a fork, a fruit fork or a knife.

4. The versatile tableware device of claim 1, wherein the tableware member being swayed into the receiving space has a first position, and the tableware member being swayed out of the opening has a second position.

5. The versatile tableware device of claim 4, wherein the second position is the tableware member being swayed 180 degrees from the first position.

6. The versatile tableware device of claim 1, further comprising a hook portion which is rotatably connected to the pivoting portion and outward extends out of the main body.

7. The versatile tableware device of claim 1, wherein the pivoting portion is comprised of two spindle holes at an end of the upper cover and a spindle at an end of the lower cover.

8. The versatile tableware device of claim 7, wherein the adapting portion is an annular trough.

9. The versatile tableware device of claim 1, wherein the first connecting portion is a shaft, the second connecting portion is a sleeve, a lateral edge of the shaft is formed with a notch, an inner edge of the sleeve is formed with a protrusion matching the notch, a bottom of the shaft has an adapting portion, the adapting portion is arranged corresponding to the protrusion, and the protrusion is slid into the notch to enter the adapting portion to be slidable on the shaft.

10. The versatile tableware device of claim 1, wherein the tableware member further has a third position at which the tableware member is capable of being removed, and the third position is the tableware member being swayed 90 degrees from the first position or the second position.

11. The versatile tableware device of claim 1, wherein each of two sides of the lower cover is provided with an extending portion, each extending portion is outward extended with the second fastener, each of two sides of the upper cover is provided with a recess portion, an inner side of each recess portion is formed with the first fastener, and the second fastener engages with the first fastener when the upper cover and the lower cover are closed.

12. The versatile tableware device of claim 11, wherein the second fastener is a block, the first fastener is a hole matching the block, and the extending portion and the recess portion are shaped into corresponding contours.

* * * * *